US005950255A

United States Patent [19]

Thompson

[11] Patent Number: 5,950,255

[45] Date of Patent: Sep. 14, 1999

[54] SHOWER CURTAIN ASSEMBLY

[75] Inventor: Greg Thompson, Apex, N.C.

[73] Assignee: Bob Barker Company, Inc., Fuquay-Varina, N.C.

[21] Appl. No.: 09/049,177

[22] Filed: Mar. 27, 1998

[51] Int. Cl.[6] ..... A47K 3/14

[52] U.S. Cl. ..... 4/557; 4/608; 160/DIG. 6; 160/368.1; 248/251

[58] Field of Search ..... 4/607, 608, 557, 4/558, 610; 160/DIG. 6, 354, 368.1, 387; 248/205.2, 251, 320, 264, 265; 211/105.1, 118

[56] References Cited

U.S. PATENT DOCUMENTS

| | | | |
|---|---|---|---|
| 2,840,155 | 6/1958 | Stern | 4/558 |
| 4,043,528 | 8/1977 | Benoit et al. | 248/251 |
| 4,643,318 | 2/1987 | Kopp | 211/123 |
| 5,191,922 | 3/1993 | Wade | 160/DIG. 6 |
| 5,216,766 | 6/1993 | Lang | 4/610 |
| 5,337,425 | 8/1994 | Hill | 4/608 |
| 5,465,776 | 11/1995 | Mirza | 160/368.1 |
| 5,651,407 | 7/1997 | Perez | 160/DIG. 6 |
| 5,657,886 | 8/1997 | Tacchella | 4/610 |
| 5,794,281 | 8/1998 | Shearon | 4/608 |

*Primary Examiner*—Charles R. Eloshway
*Attorney, Agent, or Firm*—Rhodes, Coats & Bennett, L.L.P.

[57] ABSTRACT

A shower curtain assembly for enclosing an opening in a shower enclosure in environments where there is a risk that an individual might attempt to use a part of the shower curtain assembly to cause injury to himself or others. The assembly is constructed of a foam plastic curtain support, a shower curtain attached at its upper edge to the curtain support, and releasable attachments that include hook-and-loop fasteners attached at opposite ends of the curtain support to attach the assembly across the enclosure opening. The shower curtain assembly may also include a cover around the curtain support, with the upper edge of the curtain being releasably attached to the cover.

13 Claims, 7 Drawing Sheets

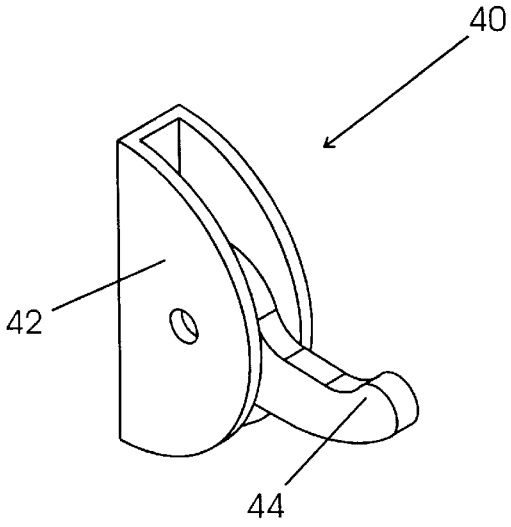
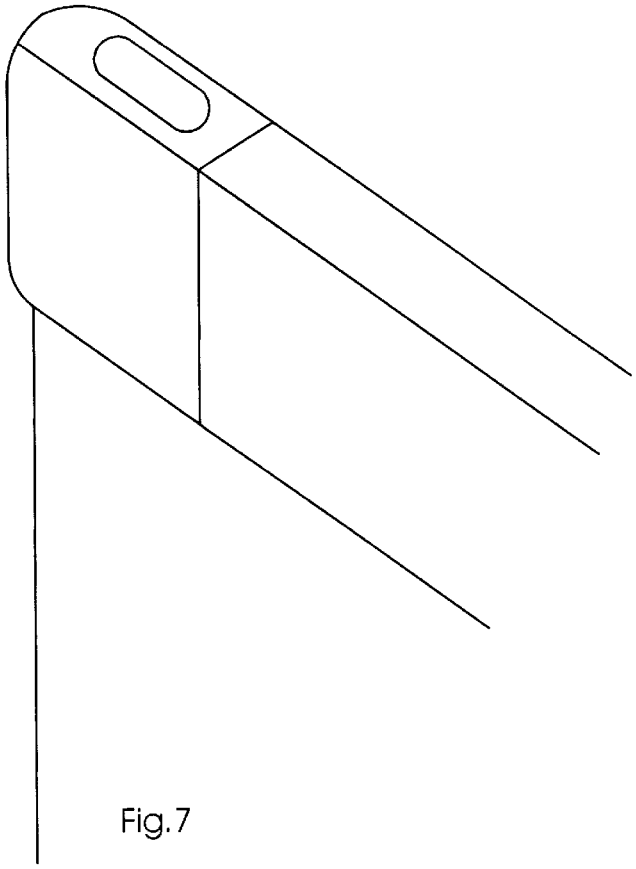
Fig.7

SHOWER CURTAIN ASSEMBLY

FIELD OF THE INVENTION

The present invention relates generally to an improved shower curtain assembly, and in particular to a shower curtain combined with a curtain support for use under conditions where an individual might attempt to use the shower curtain support to cause harm to himself or to others.

BACKGROUND OF THE INVENTION

In prisons and other institutional facilities, showers are provided for use by several individuals. In some facilities, these showers are divided into individual stalls or compartments with an opening on one side enclosed by a shower curtain for privacy.

These shower curtains are normally comprised of a water-impermeable sheet that is vertically suspended across a wall or doorway of the shower compartment by attaching the upper end of the sheet to a shower curtain support. For example, the support may be a telescoping metal rod with fasteners at opposed ends to secure the rod in a horizontal position at a desired height to spaced parts of the enclosure, such as the opposed sides of a doorway into the shower enclosure.

Unfortunately, two problems arise when such curtain supports are used for supporting shower curtains in facilities such as prisons, mental institutions, and the like. First, some of the inmates of such facilities are prone to suicide, and may attempt to hang themselves from the shower curtain rod or support, particularly since the shower area is one of the few areas where there is sufficient privacy to attempt suicide without being restrained. Second, since fights between inmates in these facilities often occur in shower areas, shower curtain rods may be used as weapons, causing injury to inmates.

In order to eliminate these concerns, while still achieving the privacy desired, there is a need for a shower curtain assembly that cannot be used as a support for suicide attempts, or as a weapon against others. A shower curtain assembly meeting these requirements, especially a shower curtain assembly of this type that could be economically manufactured and easily laundered or replaced would be especially useful.

SUMMARY OF THE INVENTION

The present invention provides an economical shower curtain assembly comprised of a curtain support and shower curtain that can be used to enclose or curtain-off a part of a shower enclosure, but which cannot be used as a support for attempted suicides or as an effective weapon. Generally, the shower curtain assembly of the present invention is comprised of a curtain support, a curtain, a curtain fastener for securing the curtain to the curtain support, and releasable attachments for attaching the curtain assembly to the adjacent walls on either side of the entry to the shower.

The curtain support, unlike prior art support rods, is an elongated rod of a lightweight flexible material, such as plastic foam. The rod, to meet the requirements of the present invention, should be of sufficient structural rigidity to support the weight of the curtain, even when wet, as well as forces normally exerted against the curtain in normal use. However, the rod should be bendable when subjected to higher pulling forces, such as the weight of a human body. Also, the material should be soft enough to prevent its use as a weapon against others.

In order to secure the curtain assembly across the desired area, releasable attachments are positioned at the outer ends of the rod. These attachments may comprise a strap secured to each end of the rod for suspending the rod above the entry to the shower. The flexible strap may include a hook and loop fastener which engages with a mating hook-and-loop fastener section fixed on the wall. the releasable fastener can support the weight of the curtain assembly but will not larger forces. In particular, the fasteners will not support the weight of a person attempting suicide by hanging.

Accordingly, one aspect of the present invention is to provide a shower curtain assembly for enclosing an opening in a shower enclosure comprised of a shower curtain having an upper edge, a curtain support rod, a curtain fastener attaching the upper edge of the curtain to the support rod, and releasable attachments secured including hook-and-loop fasteners at opposite ends of the rod to attach the assembly across the opening.

These and other aspects of the present invention will become apparent to those skilled in the art after a reading of the following description of the preferred embodiment.

BRIEF DESCRIPTION OF THE DRAWINGS

FIG. 7 is perspective view of a part of a shower curtain assembly at its upper end, showing a third releasable attachment for attaching the curtain assembly to the enclosure wall.

DETAILED DESCRIPTION OF THE INVENTION

Figure 1:
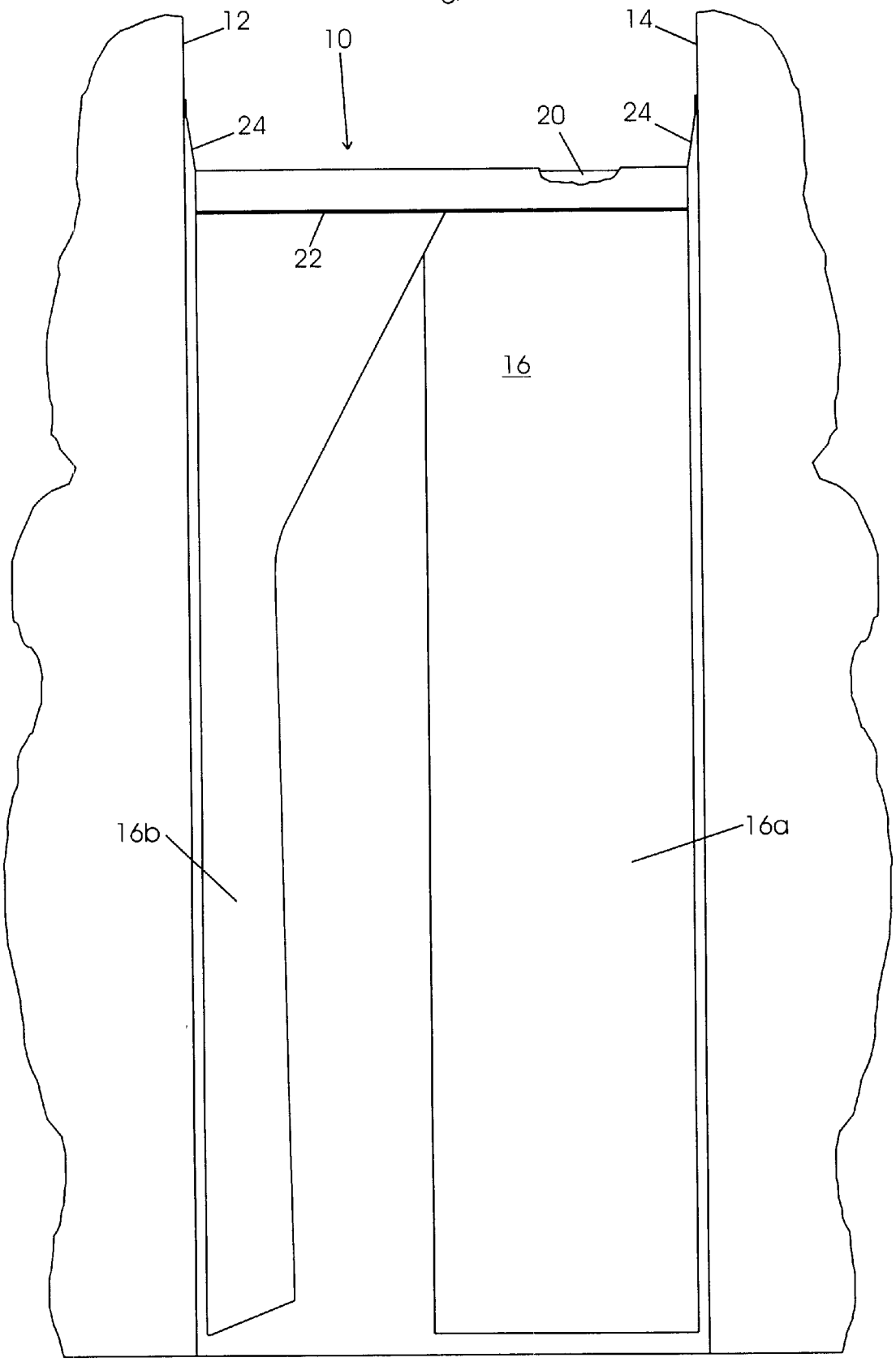
FIG. 1 is an elevation view of the shower curtain assembly mounted within a shower enclosure opening.

FIG. 1 illustrates a preferred embodiment of the shower curtain assembly indicated generally by the numeral 10. The curtain assembly 10 is mounted between opposed walls 12 and 14 adjacent the entry to a shower area. Curtain assembly 10 is comprised of a curtain 16 formed of a pair of panels 16*a* and 16*b*, a shower rod 20, and an attachment means to attach the shower rod 20 to a wall, column or other vertical structure.

The shower rod 20 is constructed of a material that is rigid enough to be self-supporting but will not support the weight of a person. Preferably, the rod 20 will deform or bend under a weight of greater than about 50 pounds. Furthermore, the material should be relatively soft so the shower rod 20 cannot be used as a weapon to inflict injury to an individual struck with the shower rod 20. For example, the shower rod 20 may be made of a polyurethane or acrylic foam.

The shower rod 20 shown in the illustrations has a rectangular cross-section, although those skilled in the art will recognize that the cross-sectional shape is not an important aspect of the invention. That is, the shower rod 20 may have any cross-section desired. However, a shower rod 20 with a rectangular cross-section may require less material, and thus be more economically produced. When a rectangular shape is used, the longer dimension of the shower rod 20 should preferably be oriented in a vertical plane and the short dimension oriented in the horizontal plane. This orientation will provide the maximum support for the shower curtain 16. The length of the shower rod 20 will depend necessarily on the size of the opening to be covered. Preferably, the length of the shower rod 20 will be equal to, or slightly less than, the width of the opening to be covered.

In the embodiment shown, the dimensions of the shower rod 20 are 2 inches by 4 inches with the 4-inch side disposed in a vertical plane. About ½ inch of clearance between the end of the shower rod 20 and the adjacent wall 12 and 14 is provided at each end of the shower rod 20.

The shower rod 20 has a jacket or cover 22 that encloses the shower rod 20. One function of the jacket 22 is to enclose and protect the foam material from disintegration. The cover 20 also provides a means to attach the curtain 16 to the shower rod 20, and a means to support the shower rod 20 from the adjacent walls 12 and 14. The jacket 22 is made from a sheet material such as plastic, vinyl or fabric. The jacket 22 is formed by wrapping the sheet material around the shower rod 20 so that the ends are covered and the jacket 22 closely conforms to the surface of the shower rod 20 and then sewing or heat sealing the sheet material. Securing straps 24 are sewn or otherwise secured to the jacket 22 at each end of the shower rod 20. The function of the securing straps 24 is to provide a means for securing the shower rod 20 to the adjacent wall as will be hereinafter described.

The curtain 16 is manufactured of a sheet of a water-impermeable material, such as a plastic, vinyl or fabric, which may be made from various yarns such as cotton, polyester, nylon, polyolefins, and combinations thereof. The curtain 16 may be in the form of a single panel but preferably comprises two overlapping panels 16*a* and 16*b* that together are of a sufficient width to extend across the area to be enclosed. Thus as used herein, the term "curtain 16" is intended to encompass a curtain 16 formed of multiple panels as well as a single panel. The panels 16*a* and 16*b* generally lie within a common plane and have overlapping inner edges. To enter of leave the shower area, an individual simply parts the two panels 16*a* and 16*b* and steps through the curtain 16.

The curtain 16 may be treated with various known surface-treating materials, such as water repellant coatings, bacteriostats, etc. Clinitix Corporation sells one antibacterial agent that has been found suitable for the invention under the trademark MICROBAN. MICROBAN has no heavy metals and gives protection against bacterial growth including Ecoli, Klebsella pneumonia and Staph A.

Figure 2:
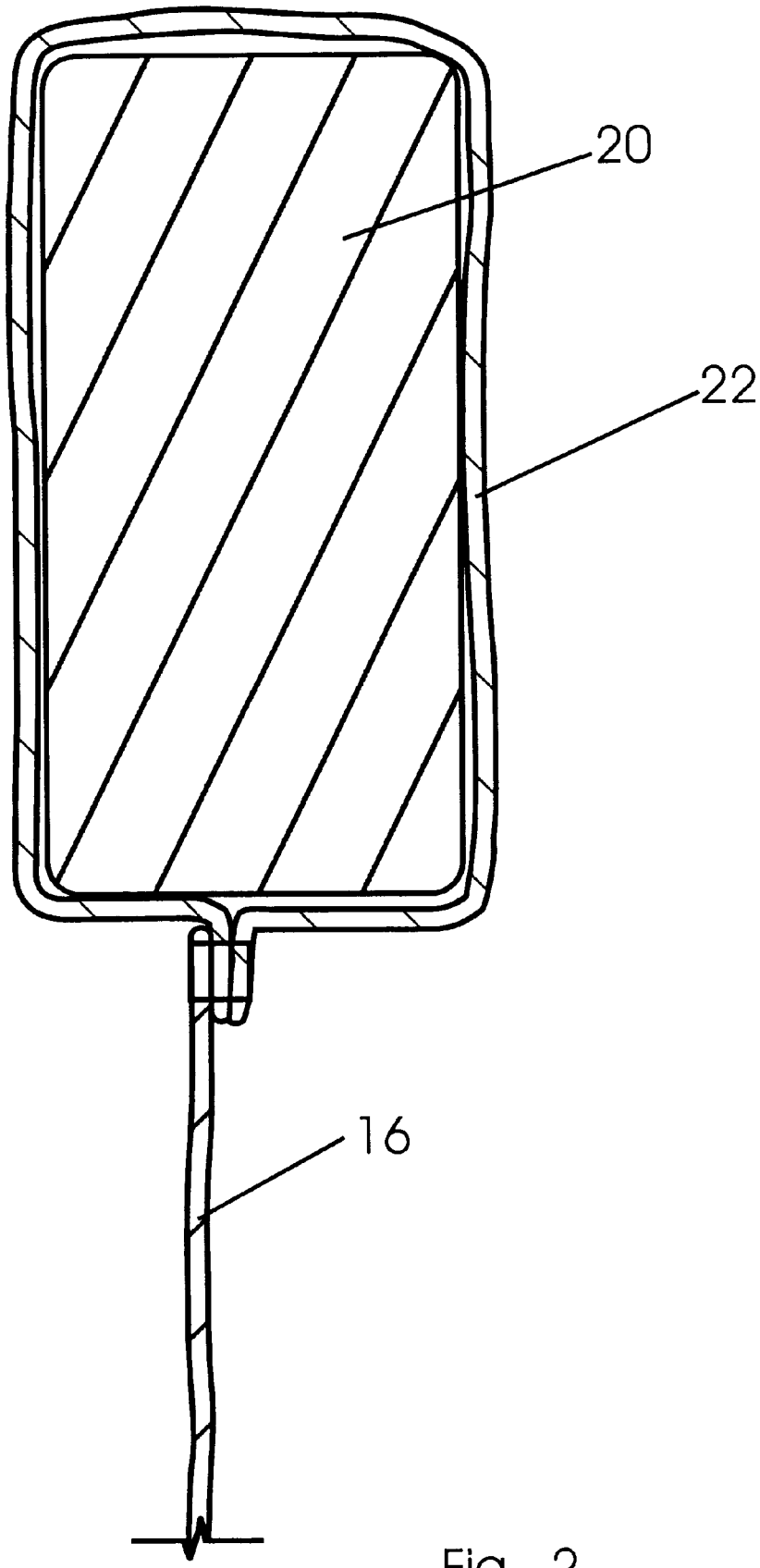
FIG. 2 is a section view of the curtain support showing a first method of attaching the curtain to the curtain support.
Figure 3:
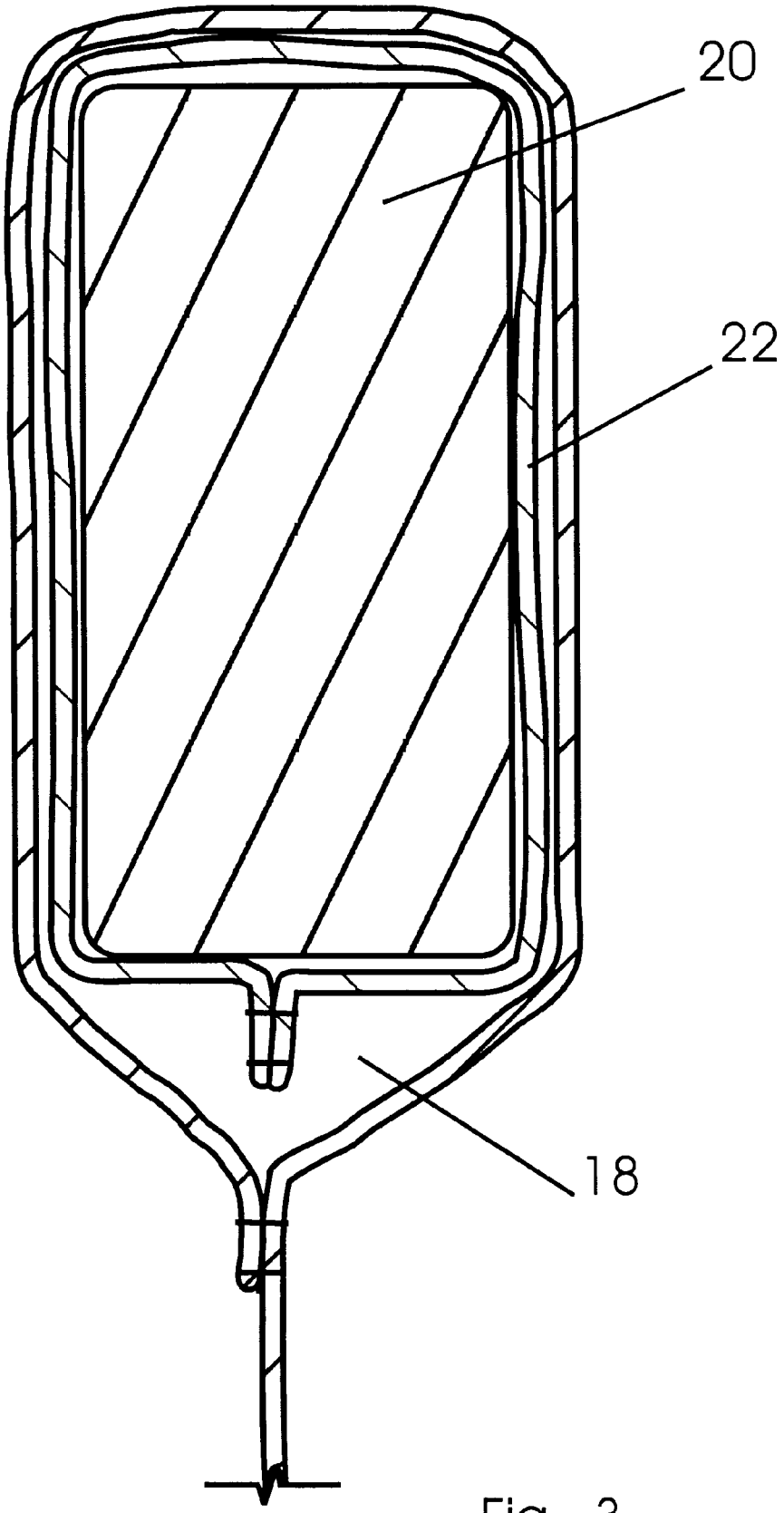
FIG. 3 is a section view of the curtain support showing a second method of attaching the curtain to the curtain support.
Figure 4:
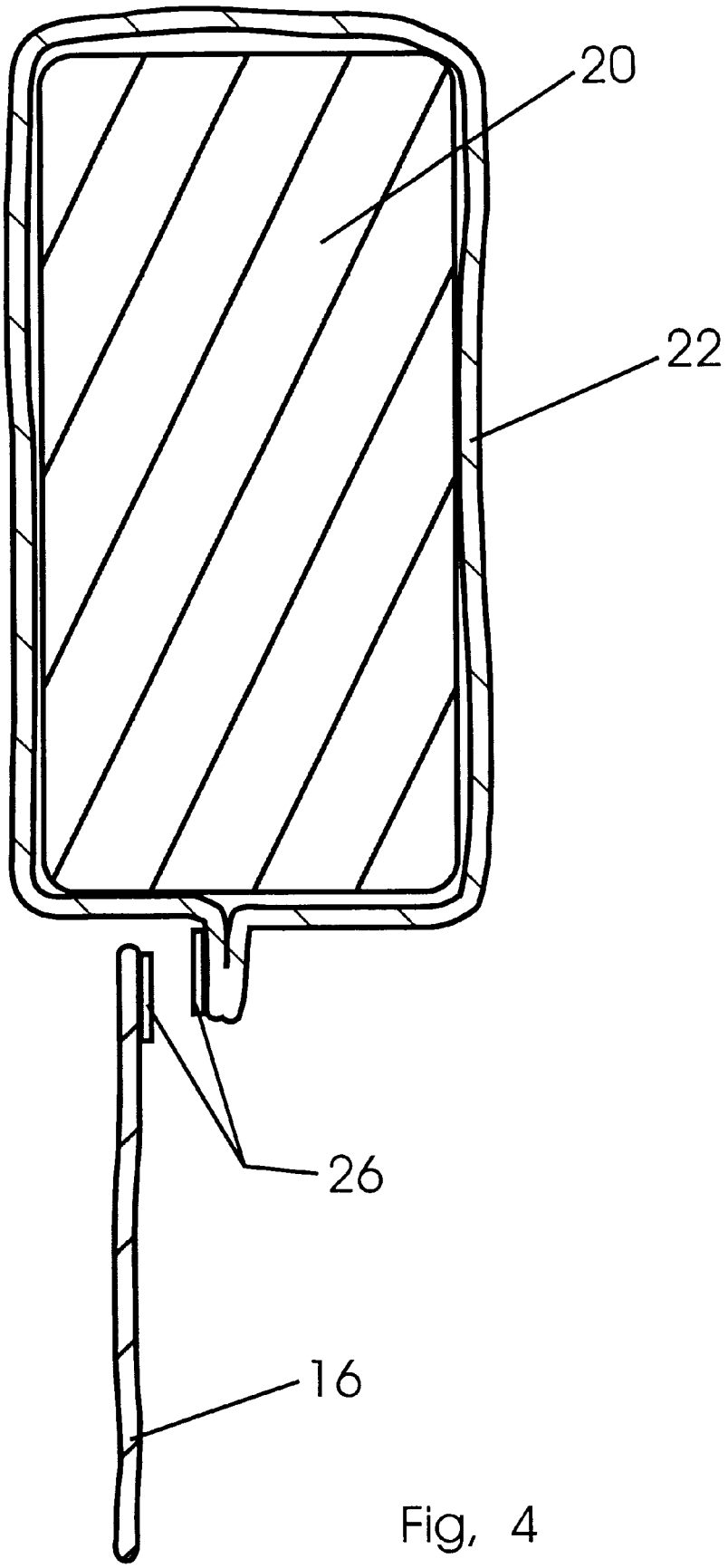
FIG. 4 is a section view of the curtain support showing a third method of attaching the curtain to the curtain support.

The curtain 16 is attachable at its upper edge to the shower rod 20, so that the curtain 16 will hang vertically across the area being enclosed. The upper edge of the curtain 16 may be permanently attached to the rod 20, as shown in FIG. 2, such as by sewing or heat fusing the curtain 16 to the jacket 22. However, in most uses the curtain 16 will be detachable from the shower rod 20 so that it can be removed for cleaning, or so that the curtain 16 can be replaced without the need to replace the shower rod 20. For this purpose, the curtain 16 includes a hem 18 extending along the upper edge thereof as shown in FIG. 3 sized to receive the shower rod 20. The shower rod 20 is passed through the hem 18 so that the ends of the rod 20 project out slightly from the curtain hem 18. Another alternative is to join the curtain 16 to the jacket by a fastener 26 that extends along the underside of the rod 20 as shown in FIG. 4. The fastener 26 may extend the entire length of the rod 20 or may comprise a series of fasteners 26 disposed at increments along the length of the rod 20. The fastener 26 may for example comprise a cooperative fastener, such as a hook and loop fastener, with mating fastener sections attached to the curtain 16 and jacket 22 respectively. Other cooperative fasteners include snaps, hooks, zippers, or any other known means of attaching two sheets together.

Figure 5:
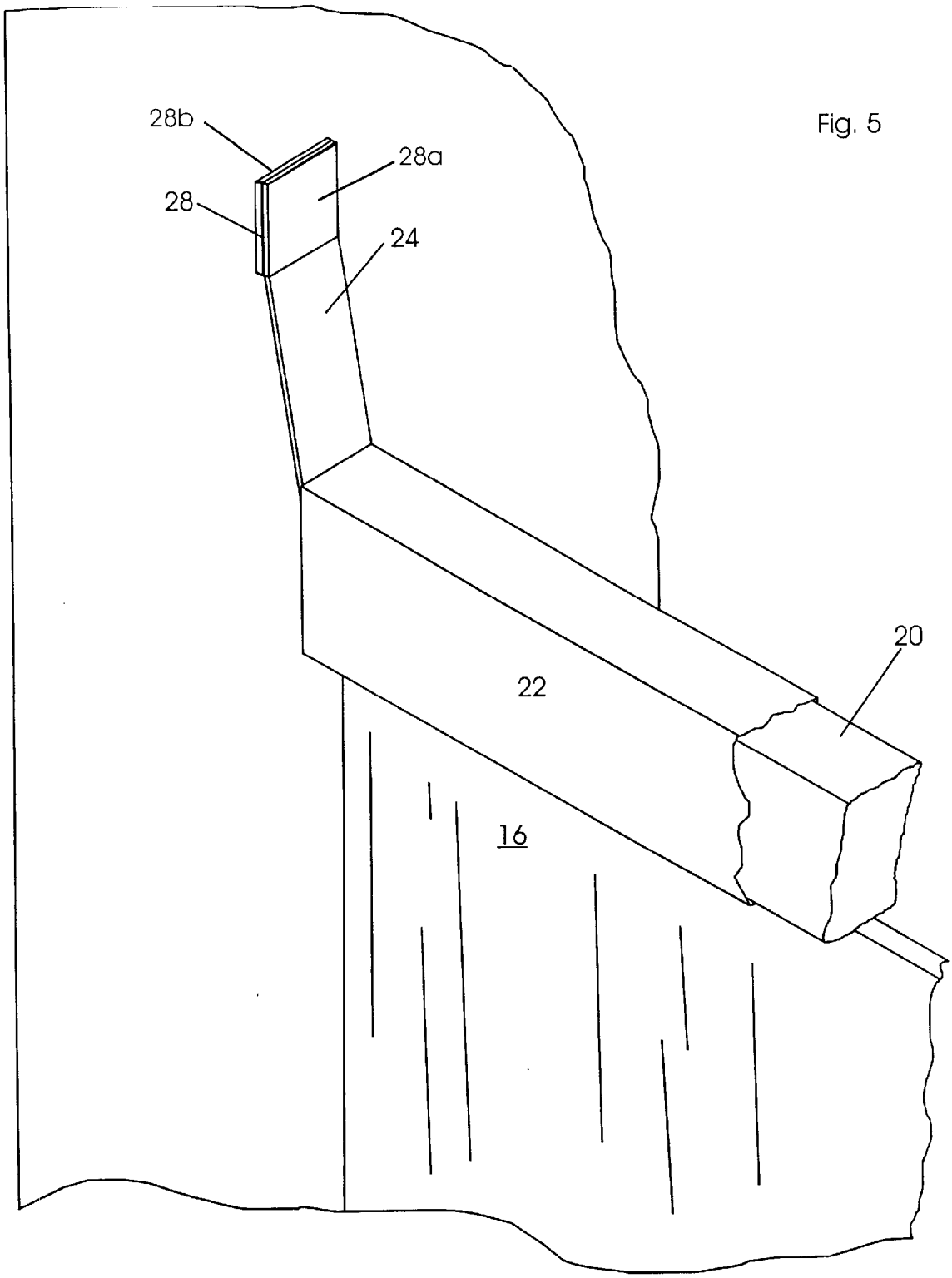
FIG. 5 is perspective view of a part of a shower curtain assembly at its upper end, illustrating one type of releasable attachment for attaching the curtain assembly to the enclosure wall.

The securing straps 24 on the jacket 22 suspend the rod 20 and the attached curtain 16 from a wall surrounding the entry to the shower area. The securing straps 24 includes one part 28*a* of a cooperative fastener 28, such as hook and loop type fastener, at the free end thereof as shown in FIG. 5. The mating part 28*b* of the cooperative fastener 28 preferably has an adhesive backing and is fixed to the wall adjacent the entry to the shower area. To secure the rod 20 in place, the first part 28*a* of the cooperative fastener 28 on the securing strap 24 is engaged with the second part 28*b* of the cooperative fastener 28 on the wall. The shower rod 20 can be removed by simply pulling on the securing straps 24 with enough force to overcome the resistance of the cooperative fasteners 28.

Figure 6:
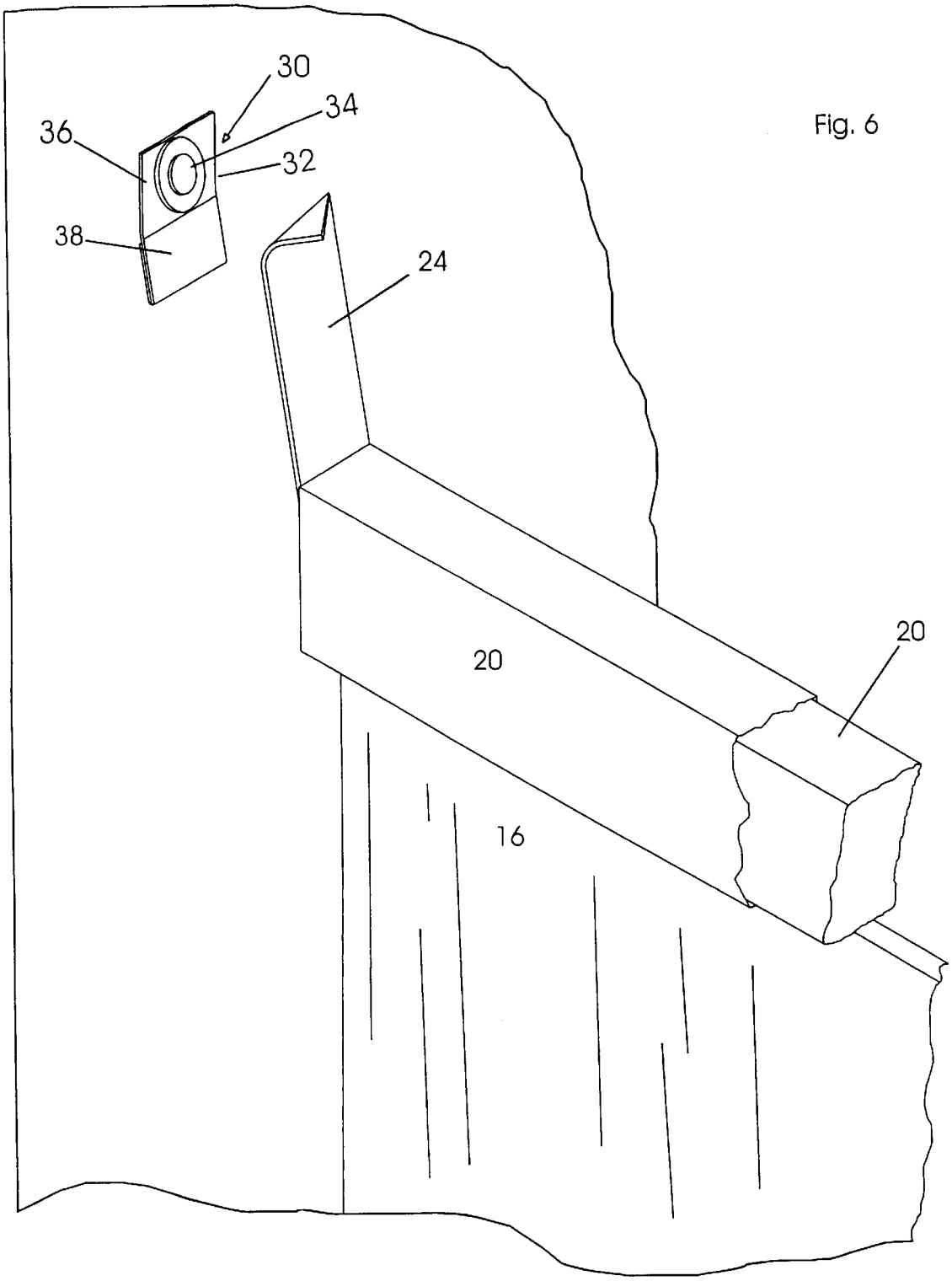
FIG. 6 is perspective view of a part of a shower curtain assembly at its upper end, showing a second releasable attachment for attaching the curtain assembly to the enclosure wall.

For longer-term use, the adhesive backing on fastener part 28*b* may not provide a secure attachment, particularly in the humid shower environment. For long-term use, a support tab 30 as shown in FIG. 6 is used to support the curtain assembly 10. The support tab 30 includes an upper end 32 bolted to the wall and a lower end 38 to which the curtain assembly 10 is attached. The support tab 30 has an eyelet 36 formed in the upper end 32. An anchor bolt 34 passes through the eyelet 36 in the support tab 30 and extends into the wall to which the curtain assembly 10 is attached. The cooperative fastener 28*b* is attached to the lower end 34 of the support tab 30. This method provides a more secure means of fixing the cooperative fastener 28*b* to the wall than an adhesive backing. Alternatively, the securing strap 24 itself may be formed with an eyelet (not shown) and attached directly to the wall by an anchor bolt. This method is the most permanent of the three described herein but makes in more difficult to install and replace the curtain assembly 10.

FIG. 7 shows another method for supporting the curtain assembly 10. In the embodiment shown in FIG. 7, a pivot hook 40 is attached to the wall. The pivot hook 40 includes a bracket 42 and a hook 44. The hook 44 engages the end of the curtain rod 20. The hook 44 is spring biased to the position shown in FIG. 7. The spring exerts sufficient force to support the curtain assembly during normal use. However, when a force greater than a predetermined amount is applied to the curtain rod 20, the hook 44 pivots down to release the end of the curtain rod 20.

To mount the shower curtain assembly, the curtain is secured to the curtain rod which in turn is secured to the releasable attachments on the wall adjacent the shower enclosure. During normal use, the releasable attachments and rod are of sufficient strength to support the shower curtain assembly 10. However, in the event that an individual attempts to use the shower assembly to hang himself, the enclosure fasteners will be torn loose and/or the rod will deform, i.e., bend or break, so that the assembly 10 will not carry the weight of the individual. Also, the structure of the assembly, and in particular the rod 20, is of such a lightweight, flexible nature that it has no utility as a weapon.

In most applications, the bendable rod will be used in combination with the releasable attachments to obtain all of the advantages of the present invention. However, these components may be employed separately, e.g., the bendable rod can be used without the releasable attachments, or the releasable attachments can be used without the bendable rod.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A shower curtain assembly for enclosing an opening in a shower enclosure comprising:

a) a shower curtain;

b) a curtain support having opposing ends for supporting said shower curtain;

c) releasable attachments disposed at opposite ends of said curtain support to releasably attach said curtain assembly to a support structure, said releasable attachments comprising flexible straps attached at opposed ends of said curtain support and a cooperative fastener for securing the flexible straps to said support structure, wherein said releasable attachments can support the weight of the curtain assembly but fail when a predetermined force greater than the weight of the curtain assembly is applied to the curtain support.

2. The curtain assembly according to claim 1 wherein said cooperative fastener includes a first part attached to said flexible strap and a second part fixed to said support structure.

3. The curtain assembly according to claim 2 wherein said cooperative fastener is a hook and loop type fastener.

4. The curtain assembly according to claim 1 wherein said curtain is releasably attached to said curtain support.

5. The curtain assembly according to claim 4 wherein said curtain includes a hem along an upper edge thereof, and wherein said curtain support extends through said hem in said curtain.

6. The curtain assembly according to claim 4 wherein said curtain is attached to said curtain support by a cooperative fastener.

7. The curtain assembly according to claim 6 wherein said cooperative fastener is a hook and loop type fastener.

8. The curtain assembly according to claim 1 wherein said curtain is permanently fixed to said curtain support.

9. The assembly according to claim 1 wherein said curtain is formed of two panels.

10. The assembly according to claim 1 wherein said curtain support is made of a flexible material.

11. The curtain assembly according to claim 10 wherein said flexible material is a foamed plastic.

12. The assembly according to claim 1 wherein said curtain support includes a support member and a cover surrounding said support member.

13. The assembly according to claim 12 wherein said curtain is releasably attached to said cover.

* * * * *